US007146680B2

(12) United States Patent
Kim

(10) Patent No.: US 7,146,680 B2
(45) Date of Patent: Dec. 12, 2006

(54) CASTER FOR VACUUM CLEANER AND VACUUM CLEANER HAVING THE SAME

(75) Inventor: Sung-Guen Kim, Changwon (KR)

(73) Assignee: LG Electronics, Inc., Seoul (KR)

( * ) Notice: Subject to any disclaimer, the term of this patent is extended or adjusted under 35 U.S.C. 154(b) by 620 days.

(21) Appl. No.: 10/370,484

(22) Filed: Feb. 24, 2003

(65) Prior Publication Data

US 2004/0045121 A1 Mar. 11, 2004

(30) Foreign Application Priority Data

Sep. 11, 2002 (KR) ..... 10-2002-0054987

(51) Int. Cl.
*A47L 9/00* (2006.01)

(52) U.S. Cl. ..... 15/339; 15/327.2

(58) Field of Classification Search ..... 15/339, 15/327.7, 327.2; 16/31, 43, 45, 47, 18 B; 280/37

See application file for complete search history.

(56) References Cited

U.S. PATENT DOCUMENTS 292,797 A * 2/1884 Eberle ..... 16/47
2,659,100 A * 11/1953 Cramer ..... 16/22
2,814,358 A * 11/1957 Beede et al. ..... 96/403
3,210,793 A * 10/1965 Waters ..... 15/339
3,881,535 A * 5/1975 Du Bois et al. ..... 15/327.2
3,894,310 A * 7/1975 Screen et al. ..... 16/47
4,852,208 A * 8/1989 Morishita et al. ..... 15/339
5,224,238 A * 7/1993 Bartlett ..... 15/327.2
5,373,606 A * 12/1994 Bosyj et al. ..... 15/323
5,701,631 A * 12/1997 Lindquist ..... 15/339
6,928,690 B1 * 8/2005 Ji ..... 15/339
2005/0015917 A1 * 1/2005 Mattingly et al. ..... 15/327.2

FOREIGN PATENT DOCUMENTS

JP 3-251220 * 11/1991

* cited by examiner

*Primary Examiner*—Theresa T. Snider
(74) *Attorney, Agent, or Firm*—Fleshner & Kim, LLP

(57) ABSTRACT

A caster structure for a vacuum cleaner is provided which allows the main body of the vacuum cleaner to be stably positioned at an incline. The caster structure is rotatably supported on a front portion of a bottom surface of the main body of the vacuum cleaner, and includes a caster body which has a planar rear surface, and a caster roller rotatably installed in the caster body 52. The planar rear surface of the caster body includes a slip-prevention protrusion which extends across the planar rear surface to prevent slippage of the main body of the vacuum cleaner when the main body is positioned at an incline. The caster structure may include a single caster, or a pair of casters positioned side by side on the bottom surface of the main body of the vacuum cleaner.

23 Claims, 4 Drawing Sheets

CASTER FOR VACUUM CLEANER AND VACUUM CLEANER HAVING THE SAME

BACKGROUND OF THE INVENTION

1. Field of the Invention

The present invention relates to a vacuum cleaner, and more particularly, to a caster for a vacuum cleaner, which is constructed such that a travel direction of the vacuum cleaner can be changed when traveling on a surface to be cleaned and a main body of the vacuum cleaner can be maintained in a state where it is put over stairs.

2. Description of the Prior Art

Referring first to FIG. 1, the entire constitution of a conventional vacuum cleaner will be described. The vacuum cleaner comprises a main body 2 with a motor contained therein for generating suction power, a connecting hose 4 that is made of a flexible material and communicates with the interior of the main body 2, an extension tube 6 connected to the connecting hose 4 and constructed such that the length of the tube can be adjusted, and a suction nozzle 8 installed at an end of the extension tube 6 to suck air containing foreign substances from a floor surface.

The motor for producing the suction power by generating vacuum and a filtering device for filtering out the foreign substances contained in the introduced air are installed within the main body 2. A pair of wheels 2*a* are installed at lower portions of the main body 2 so that the main body 2 can be moved to desired locations. A caster 10 is installed at a front portion of a bottom surface of the main body 2. The caster 10 further facilitates direction change of the main body when the main body 2 travels on the floor surface. The caster 10 comprises a caster body 12 rotatably installed on the bottom surface of the main body 2, and a caster roller 14 rotatably installed in the caster body 12. Generally, since the caster body 12 should be rotatably supported on the bottom surface of the main body 2, it is formed in a circular shape when viewed from the bottom.

When cleaning is performed using the vacuum cleaner constructed as such, the suction power is generated from the interior of the main body 2 and thus the suction nozzle 8 sucks the air containing the foreign substances from a portion to be cleaned. The sucked air is introduced into the main body 2 through the extension tube 6 and the connecting hose 4. The foreign substances are filtered out by the filtering device and then collected in one side portion within the main body 2, and the filtered air is discharged to the outside after passing by the motor in the main body to dissipate heat from the motor.

However, according to the conventional vacuum cleaner constructed as such, there is inconvenience as follows.

If the cleaning is performed on stairs by using the vacuum cleaner, the vacuum cleaner can be conveniently used only when the main body 2 can be maintained in a state where it is put over the stairs. However, the bottom surface of the main body of the conventional vacuum cleaner is substantially flat, and the wheels 2*a* and the caster 10 are supported in a state where they protrude from a plane of the bottom surface.

In order to cause the vacuum cleaner to be maintained in the state where it is put over the stairs, there is a need for a portion to be caught by an edge of one step of the stairs in the bottom surface of the main body of the vacuum cleaner. However, since only the caster 10 protrudes in the structure of the bottom surface of the main body of the conventional vacuum cleaner, it is the caster roller 14 of the caster 10 that can be supported by the edge of the step.

However, since the conventional caster roller 14 is constructed to be rotatable and has an insufficient length in a right and left direction, there is a difficulty in supporting the main body of the vacuum cleaner in the state where it is put over the stairs. Moreover, since the caster body 12 is formed in the circular shape and simultaneously designed to be rotatable on the same plane as the bottom surface of the main body, it is rotated even though any one portion of the caster body comes into contact with a portion of the edge of the step. Therefore, it is substantially impossible to support the main body of the vacuum cleaner in the state where it is put over the linear protruding edge of the step.

As can be understood from the above, with the structure of the main body of the conventional vacuum cleaner, there is a disadvantage in that it is inconvenient to clean the stairs since the main body cannot be maintained in the state where it is put over one of the stairs.

SUMMARY OF THE INVENTION

The present invention is conceived to solve the above problem in the prior art. An object of the present invention is to provide a caster for a vacuum cleaner constructed to be stably supported by stairs in a state where a main body of the vacuum cleaner is slantingly put over the stairs.

According to one aspect of the present invention for achieving the above object, there is provided a caster for a vacuum cleaner installed at and rotatably supported on a front portion of a bottom surface of a main body of the vacuum cleaner, comprising a caster body protruding from the bottom surface to be rotatably supported on a horizontal plane and having a planar rear surface with a predetermined width; and a caster roller rotatably installed on a bottom surface of the caster body.

Preferably, the rear surface of the caster body is formed with a slip-prevention protrusion extending in a right and left direction.

According to another aspect of the present invention, there is provided a vacuum cleaner comprising a main body containing a means for generating suction power therein; a pair of wheels installed at rear portions of the main body for enabling the main body to travel on a floor surface; and a pair of right and left casters installed at front portions of a bottom surface of the main body. Each of the casters comprises a caster body protruding from the bottom surface of the main body to be rotatably supported on a horizontal plane and having a planar rear surface with a predetermined width; and a caster roller rotatably installed on a bottom surface of the caster body.

The vacuum cleaner of the present invention can be stably supported in the state where the main body of the vacuum cleaner is slantingly put over the stairs. Thus, it can be expected to obtain an effect of very convenient cleaning of the stairs.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Figure 1:
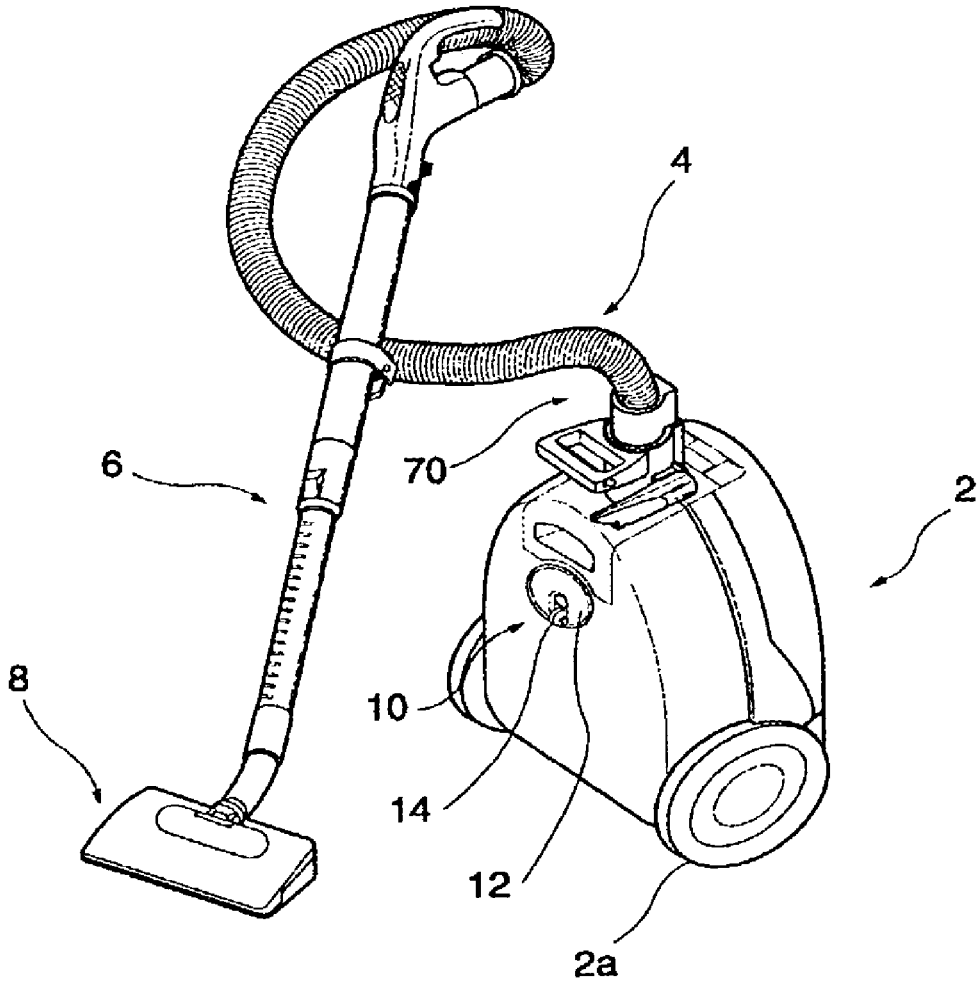
FIG. 1 (PRIOR ART)
FIG. 1 is an exemplary perspective view of a conventional vacuum cleaner.
Figure 2:
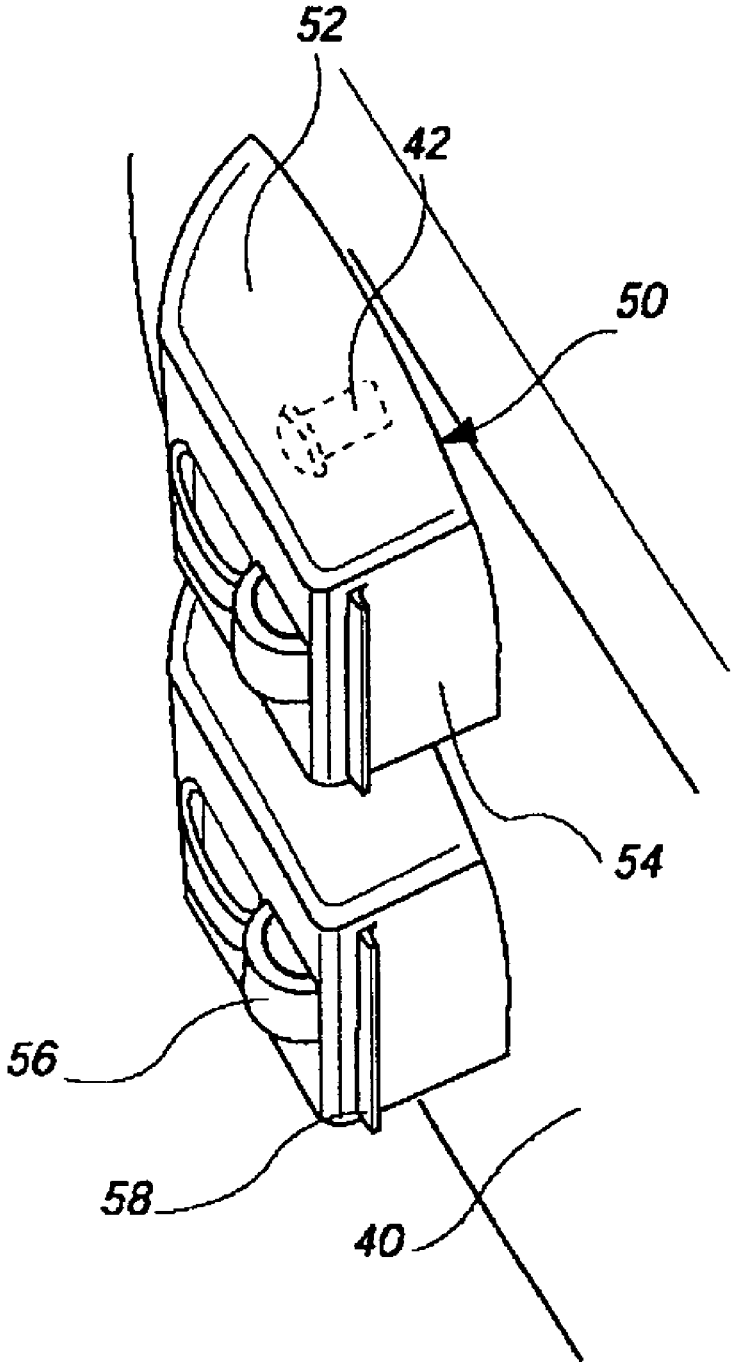
FIG. 2 is a perspective view showing a bottom surface of a main body of a vacuum cleaner according to the present invention when viewed from the rear thereof.
Figure 3:
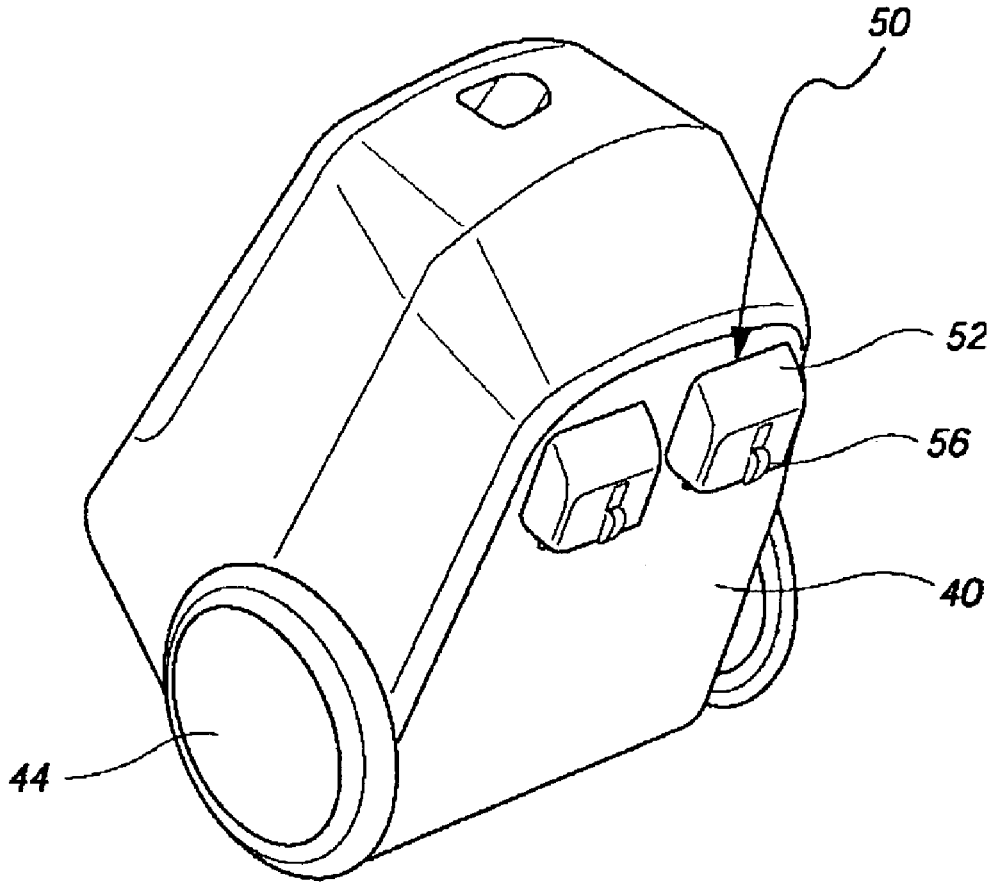
FIG. 3 is a perspective view showing the bottom surface of the main body of the vacuum cleaner according to the present invention when viewed from the front thereof.

Hereinafter, the present invention will be described in detail with reference to a preferred embodiment shown in the accompanying drawings. FIGS. 2 and 3 are perspective views showing a bottom surface of a main body of a vacuum cleaner according to the present invention. As shown in these figures, a caster 50 is installed to be rotatably supported at a front portion of the bottom surface 40 of the main body of the vacuum cleaner. It will be apparent that the vacuum cleaner of the present invention includes a suction power generating means capable of generating suction power therein, specifically a motor capable of generating vacuum within the main body of the vacuum cleaner.

In the illustrated embodiment, it can be seen that the caster 50 is in pairs in a right and left direction. Each caster 50 is installed to be supported rotatably on a horizontal plane so that a travel direction of the vacuum cleaner can be more smoothly changed when traveling on a floor surface.

For example, each caster 50 is constructed such that it can rotate about a rotation shaft 42 that is molded or installed to protrude downward from the bottom surface 40 of the main body. Further, it will be apparent that various modifications may be made to components for allowing the caster 50 itself to be rotated. Moreover, the caster 50 of the present invention is installed to protrude downward from the bottom surface 40 of the main body of the vacuum cleaner.

Each caster 50 of the present invention comprises a caster body 52 that defines an external appearance of the caster and is rotatably supported by the rotation shaft 42, and a caster roller 56 that is installed on a bottom surface of the caster body 52 and is in rolling contact with the floor surface to allow the main body of the vacuum cleaner to travel on the floor surface.

At this time, since a pair of wheels 44 (FIG. 4) are installed at rear portions of the main body of the vacuum cleaner according to the present invention, the structure for enabling the main body to be moved to desired locations is the same as the conventional vacuum cleaner.

Figure 4:
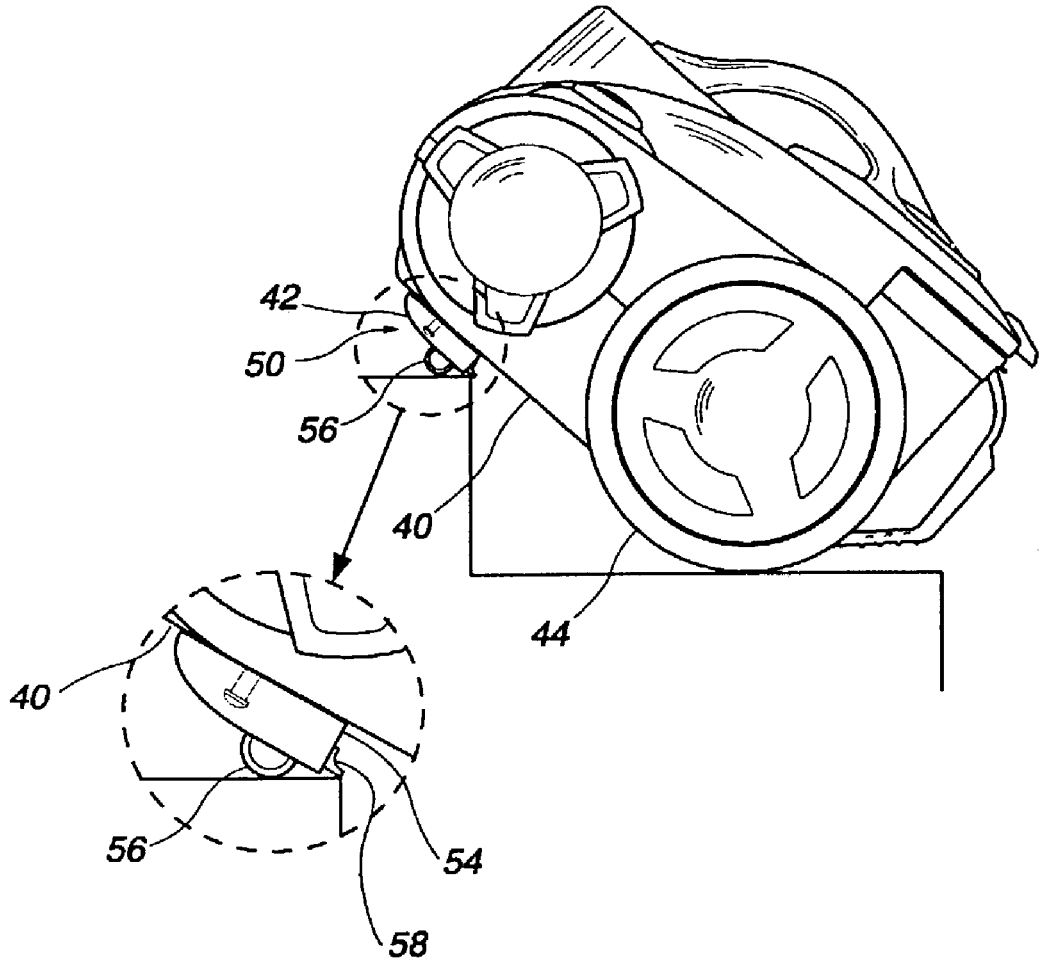
FIG. 4 is a side view showing a use state of the vacuum cleaner according to the present invention.

A rear surface 54 of the caster body 52 in the present invention is formed to take a planar shape. The planar rear surface 54 of the caster body 52 is intended to maintain the state where it is put over and caught by an edge of one step of the stairs. That is, the planar surface 54 with a predetermined width is constructed to come into contact with the edge of the step and maintain the contact state. Further, if the caster body 52 formed with the planar surface 54 is in pairs in the right and left direction, the vacuum cleaner can be substantially supported in an inclined state over the stairs while the rear surface 54 of each caster body is caught by the edge of the step. FIG. 4 shows the state where the main body of the vacuum cleaner is put over and supported by the stairs.

It will be apparent that the caster body 52 may be variously modified in view of its entire shape so far as the rear surface 54 is formed in a planar shape to have a predetermined linear width.

Furthermore, the rear surface 54 is formed with a slip-prevention protrusion 58 extending in the right and left direction. The slip-prevention protrusion 58 is constructed to simultaneously be in contact with the top of the edge of the step so as to prevent the rear surface from slipping on the step when the rear surface 54 is in contact with the top of the edge of the step. Such a use state of the vacuum cleaner is shown in FIG. 4.

It can be understood from the above description that the subject matter of the invention is to form the rear surface of the caster 50, which is rotatably installed on the bottom surface 40 of the main body of the vacuum cleaner, in the shape of a plane with a predetermined liner width. Further, since the caster 50 is in pairs in the right and left direction, the state where the vacuum cleaner is put over the stairs can be more easily maintained. Moreover, since the rear surface 54 is formed with the slip-prevention protrusion 58, the caster 50 of the present invention put over and supported by the stairs is further prevented from slipping thereon so that the vacuum cleaner can be supported in a more stable state.

According to the present invention, the following effects can be expected. The rear surface 54 of the caster 50 of the present invention is designed to withstand certain load in the state where it is in contact with the top of the edge of the step. Therefore, when the present invention is applied to the vacuum cleaner, the main body of the vacuum cleaner can be maintained in the state where it is slantingly put over the stairs. Consequently, it can be expected to obtain an advantage in that the cleaning of the stairs can be more conveniently performed.

It will be apparent that those skilled in the art can make various changes and modifications within the scope of the technical sprit of the invention. Further, the present invention should be construed based on the appended claims.

What is claimed is:

1. A caster structure for a vacuum cleaner configured to be installed at and rotatably supported on a front portion of a bottom surface of a main body of the vacuum cleaner, comprising:

at least one caster body which protrudes from a bottom surface of a main body of a vacuum cleaner, comprising a substantially planar rear surface of a predetermined width, wherein a portion of the substantially planar rear surface of the at least one caster body is configured to support and to stabilize the main body of the vacuum cleaner in an inclined position; and a caster roller rotatably coupled to the at least one caster body.

2. The caster structure of claim 1, wherein the substantially planar rear surface of the at least one caster body comprises a slip-prevention protrusion which extends across the substantially planar rear surface, and which is configured to support and to stabilize the main body in an inclined position.

3. The caster structure of claim 2, wherein the slip prevention protrusion extends horizontally across the substantially planar rear surface of the at least one caster body.

4. The caster structure of claim 3, wherein the slip prevention protrusion extends horizontally across a lower portion of the substantially planar rear surface of the at least one caster body.

5. The caster structure of claim 3, wherein the slip prevention protrusion comprises a strip.

6. The caster structure of claim 5, wherein the strip is rigid.

7. The caster structure of claim 1, wherein the at least one caster body comprises two caster bodies configured to be positioned side by side protruding from a front portion of the bottom surface of the main body.

8. The caster structure of claim 7, wherein the two caster bodies are configured to be positioned on the front portion of the bottom surface of the main body of the vacuum cleaner such that their respective substantially planar rear surfaces are aligned along substantially the same plane.

9. The caster structure of claim 8, wherein each of the two caster bodies comprises a slip prevention protrusion comprising a strip which extends horizontally across the substantially planar rear surface of its respective caster body.

10. The caster structure of claim 9, wherein the slip prevention protrusions which extend from the substantially planar rear surfaces of the two caster bodies are configured to be horizontally aligned with one another when the caster structure is mounted on a vacuum cleaner.

11. The caster structure of claim 1, wherein a portion of the caster roller is housed within the at least one caster body.

12. The caster structure of claim 1, wherein the at least one caster body is configured to be supported by a corresponding rotation shaft which extends from the bottom surface of the main body of the vacuum cleaner.

13. A vacuum cleaner comprising the caster structure of claim 1.

14. A vacuum cleaner, comprising:

a main body;

a pair of wheels installed at rear portions of the main body configured to enable the main body to travel on a horizontal surface; and a pair of casters installed at front portions of a bottom surface of the main body, wherein each of the pair of casters comprises:

a caster body positioned at the bottom surface of the main body, including a planar rear surface of a predetermined width; and a caster roller rotatably coupled to the caster body, wherein the pair of casters are installed on the bottom surface of the main body such that the planar rear surfaces of their respective caster bodies are aligned along substantially the same plane so as to stabilize an inclined position of the main body when the main body is supported by the casters.

15. The vacuum cleaner of claim 14, wherein each caster body comprises a slip prevention portion which extends horizontally across its planar rear surface.

16. The vacuum cleaner of claim 15, wherein the slip prevention portion comprises an element which extends outward from a lower portion of the planar rear surface.

17. The vacuum cleaner of claim 15, wherein the slip prevention portion comprises a strip.

18. The vacuum cleaner of claim 17, wherein the strip is rigid.

19. The vacuum cleaner of claim 14, wherein each caster body is configured to be supported by a corresponding rotation shaft which extends from the bottom surface of the main body.

20. A vacuum cleaner, comprising:

a main body;

a pair of rear wheels provided at a rear portion of the main body;

at least one caster provided at a forward portion of the main body, wherein the at least one caster comprises:

a caster roller rotatably coupled to a caster body provided at a bottom surface of the main body, wherein the caster body includes a substantially planar rear surface configured to stabilize an inclined position of the main body when the main body is supported by the at least one caster.

21. The vacuum cleaner of claim 20, wherein the substantially planar rear surface of the caster body of the at least one caster comprises a slip-prevention protrusion which extends across the substantially planar rear surface, and which is configured to stabilize the main body in an inclined position.

22. The vacuum cleaner of claim 21, wherein the at least one caster comprises a pair of casters provided side by side at a forward portion of a bottom surface of the main body such that the substantially planar rear surfaces of the respective caster bodies are aligned along substantially the same plane.

23. The vacuum cleaner of claim 21, wherein the slip prevention protrusion comprises a strip which extends horizontally across the substantially planar rear surface of the caster body of the at least one caster.

* * * * *